US006397579B1

(12) United States Patent
Negre

(10) Patent No.: US 6,397,579 B1
(45) **Date of Patent: *Jun. 4, 2002**

(54) INTERNAL COMBUSTION ENGINE WITH CONSTANT-VOLUME INDEPENDENT COMBUSTION CHAMBER

(76) Inventor: Guy Negre, Forum Auréllia, Route du Val, Brignoles F-83170 (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,286

(22) PCT Filed: Apr. 14, 1997

(86) PCT No.: PCT/FR97/00655

§ 371 (c)(1),
(2), (4) Date: Apr. 19, 1999

(87) PCT Pub. No.: WO97/39232

PCT Pub. Date: Oct. 23, 1997

(30) Foreign Application Priority Data

Apr. 15, 1996 (FR) ..... 96 04890

(51) Int. Cl.[7] ..... F02G 3/02
(52) U.S. Cl. ..... 60/39.6
(58) Field of Search ..... 60/39.6, 39.63

(56) References Cited

U.S. PATENT DOCUMENTS

| | | | | | |
|---|---|---|---|---|---|
| 4,149,370 | A | * | 4/1979 | Vargas | 60/39.6 |
| 4,513,568 | A | * | 4/1985 | Bajulaz | 60/39.6 |
| 4,715,326 | A | * | 12/1987 | Thring | |
| 4,783,966 | A | * | 11/1988 | Aldrich | |
| 5,311,739 | A | * | 5/1994 | Clark | 60/39.6 |

FOREIGN PATENT DOCUMENTS

| | | | | |
|---|---|---|---|---|
| DE | 4136223 | * | 12/1992 | |
| FR | 2167356 | * | 8/1973 | |
| FR | 2319769 | * | 2/1977 | |
| FR | 2416344 | * | 8/1979 | |
| JP | 3-202663 | * | 9/1991 | 60/39.6 |

* cited by examiner

*Primary Examiner*—Michael Koczo
(74) *Attorney, Agent, or Firm*—Duane Morris LLP; Arthur L. Plevy, Esq.

(57) ABSTRACT

A cyclic internal combustion engine having at least one working piston and cylinder arrangement which includes separate compression, combustion, and expansion chambers that perform respective compression combustion and expansion cycles. The compression cycle is advanced up to 180° in relation to the expansion cycle, so as to extend the combustion cycle during the exhaust stroke to reduce the formation in the combustion cycle of polluting gases.

12 Claims, 5 Drawing Sheets

INTERNAL COMBUSTION ENGINE WITH CONSTANT-VOLUME INDEPENDENT COMBUSTION CHAMBER

Figure 1:
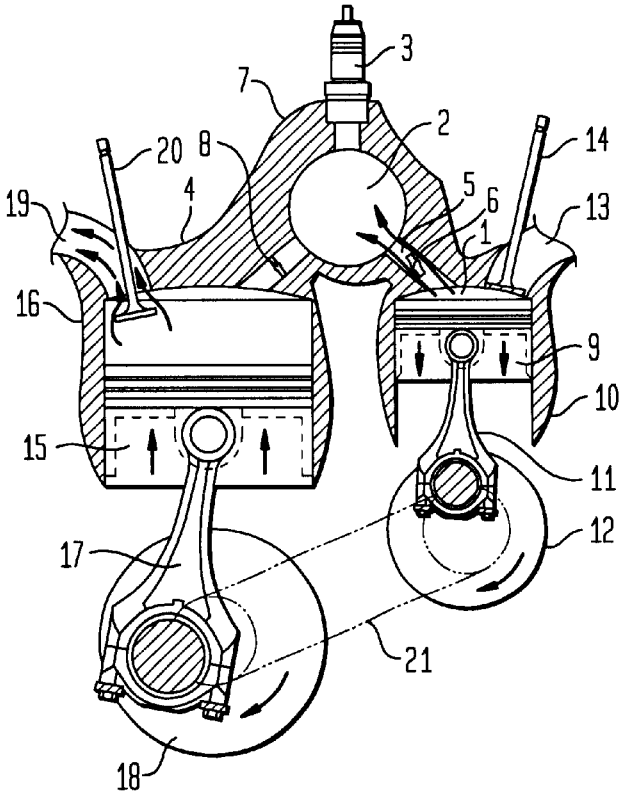

The invention relates to a cyclic internal combustion engine with an independent and constant-volume combustion chamber.

Cyclic internal combustion engines with an independent combustion chamber and separate compression and expansion chamber as described in French Patents 2319769 or alternatively 2416344 allow a certain number of improvements to be made to the operation compared with conventional engines. In this type of engine, inlet and compression take place in a chamber controlled by a piston, whereas expansion and exhaust take place in another chamber; the independent combustion chamber is connected to these chambers by ducts equipped with shutters. However, the variable volumes of these two chambers are controlled cyclically in phase and the time available for the combustion and transfer of the gaseous masses is particularly short and does not allow complete combustion to be achieved as is achieved in conventional engines.

The engine according to the invention makes it possible to alleviate this shortcoming and to make a considerable improvement in the operation of this type of engine; it is characterized by the means employed, and more specifically by the fact that the compression chamber cycle, which comprises inlet and compression, is advanced in relation to the expansion chamber cycle which comprises expansion and exhaust so that it is possible to obtain a combustion time which is far longer than in conventional engines; as a tangible example, in a conventional engine and in the engines described in the aforementioned patents, the combustion of their charge takes place over approximately 30 to 45° of rotation of their engine shaft, whereas with the engine procedure according to the invention there are up to 180° of rotation available (during the exhaust stroke) in which to fill the chamber and burn the mixture, and this, depending on the mode of filling used, may allow combustion periods of the order of 150° or even 160° of rotation of the engine shaft. Furthermore, and in order to avoid heat loss through the walls during this lengthy combustion, the chamber will or may be coated with a thermal barrier made of ceramic or other heat-insulating materials so as not to lose heat through the walls which can thus be very hot; likewise it will be particularly advantageous, this also for the same reasons, for the walls of the expansion chamber (piston crown, roof of the chamber, transfer duct, etc.) to be coated with a thermal barrier made of ceramic or other heat-insulating materials.

The operation of the engine according to the invention and the improvements made over conventional engines and over the engines described in the aforementioned patents will now be understood. The interdependency, in particular, in terms of compression chamber and expansion chamber cycle, and the thermal protection of the combustion chamber and/or of the expansion chamber allow combustion periods 3 to 4 times longer than those of conventional engines to be achieved without significant heat loss, and thus allow the efficiency to be improved; incidentally, it is also possible with this arrangement to be able to produce a combustion chamber which does not depend, at its base, on the diameter of the piston, and thus to approximate to or to achieve the ideal spherical shape without roughnesses or "corners" in which the gases do not burn and produce unburnt hydrocarbons.

These combined advantages of a long combustion period, of a compact combustion chamber shape close to that of a sphere without roughnesses or corners, thermally insulated with hot walls make it possible to obtain emissions of pollutants in the exhaust which are far lower than in conventional engines.

According to another embodiment of the invention, it is possible to form between the compression chamber and the combustion chamber a buffer volume in which compressed air is accumulated which will make it possible to avoid surge effects and pressure drops due to the dead transfer volumes and to the expansion during the filling of the combustion chamber.

The mode of operation of the compressor can therefore vary without this in any way altering the principle of the invention; although in common practice it seems convenient to employ a reciprocating compressor, any other mode of producing compressed air may be used—a single or multistage reciprocating compressor, a rotary vane compressor, a Roots-type blower or Lyshom type compressor or a turbocompressor driven by the exhaust gases. Likewise, for certain applications it is possible to employ a reserve of air from a cylinder (or other container) which will be expanded in the combustion chamber, or even compressed air from a main (in the example of a stationary engine used in a factory employing compressed air from a main).

The mode of operation of the expansion chamber can also vary without this in any way altering the principle of the invention; although in practice it also seems convenient to employ a piston sliding in a cylinder and driving a crankshaft via a connecting rod, any rotary encapsulation system can also be used—rotary with radial vanes, with rotary piston such as the path of a conchoid of a circle or of a trochoid, etc.

The engine according to the invention operates with homogeneous air-fuel mixtures and the mixing can be achieved using a carburetor prior to inlet into the compressor, but it is preferable to have a fuel-injection (electronic or mechanical) system between the compressor and the combustion chamber, although direct injection into the combustion chamber can also be used without that in any way altering the operating principle.

The engine according to the invention also operates with heterogeneous self-igniting mixtures like in diesel engines. In this case, the spark plug fitted into the chamber is omitted and a direct diesel injector supplied by a pump and its equipment of a type commonly used in diesel engines is fitted into the said combustion chamber.

Incidentally, there may be inserted at least two separate combustion chambers operating in exactly the same way as the one described hereinabove and which can be supplied together, separately or alternately in order to improve the thermodynamic efficiency at light load—for example using just one chamber for used power levels below half the total power of the engine, and using both chambers above that value.

Figure 2:
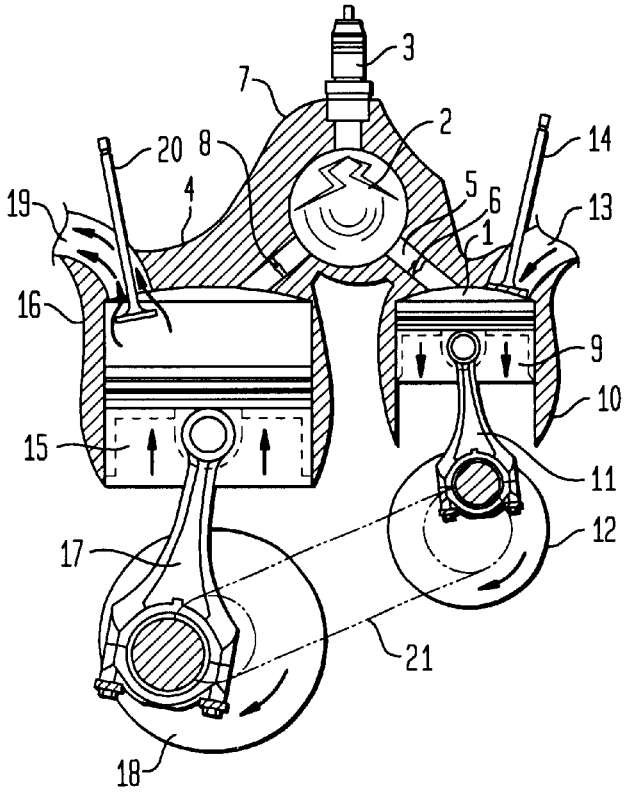
Figure 3:
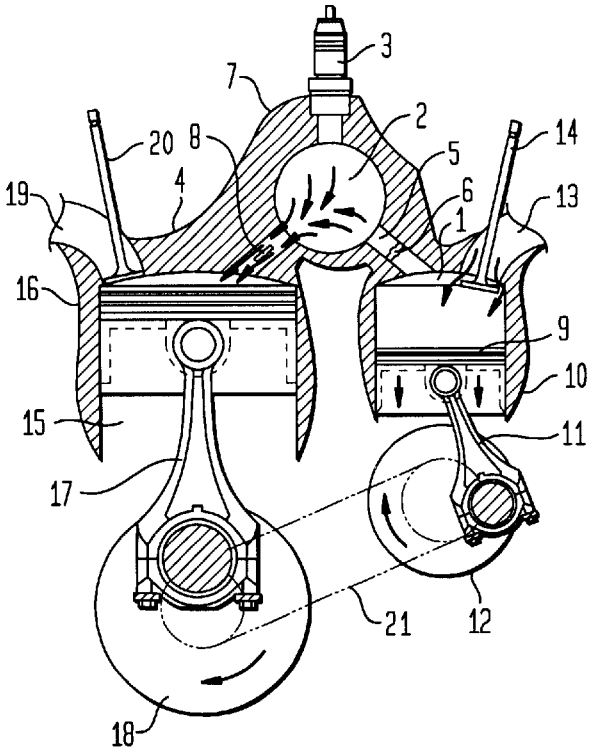
Figure 4:
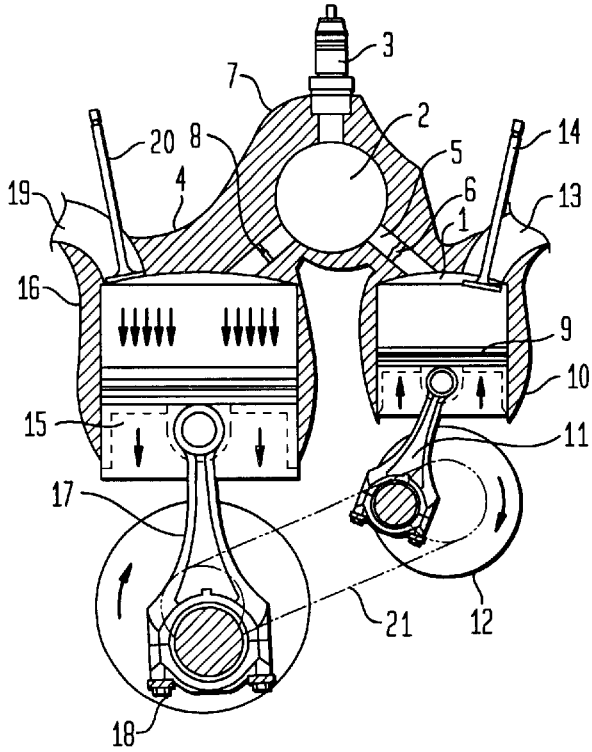
Figure 5:
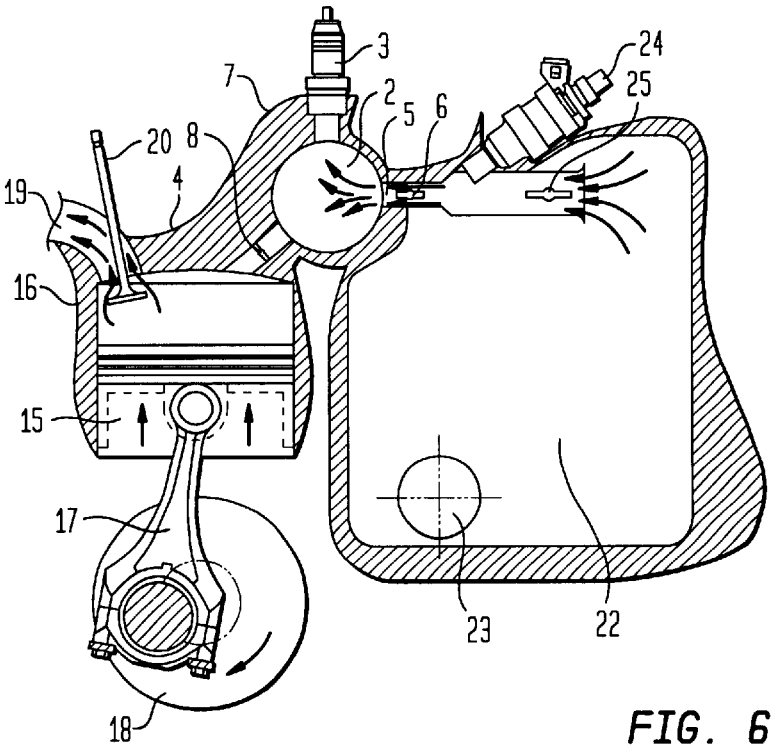
Figure 6:
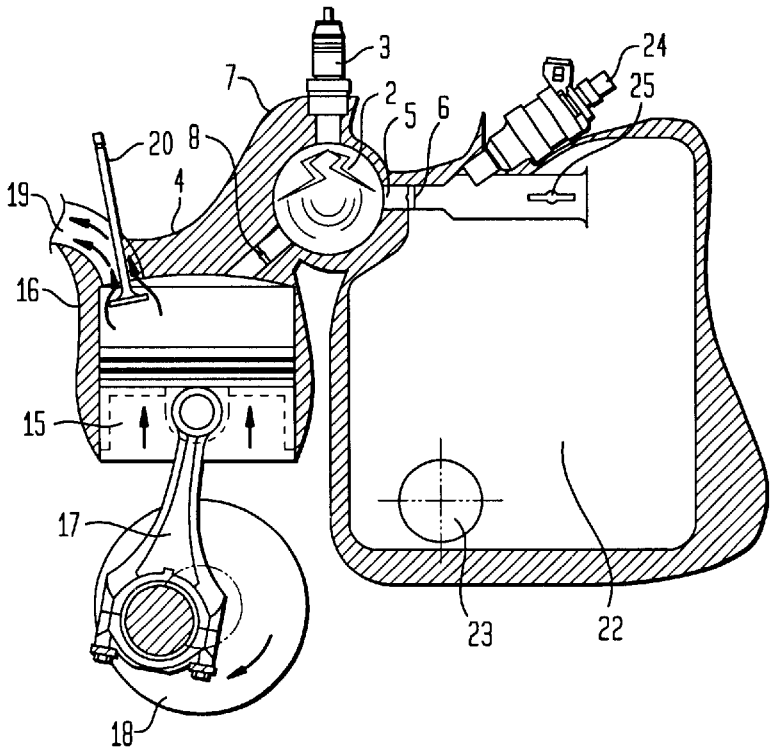
Figure 7:
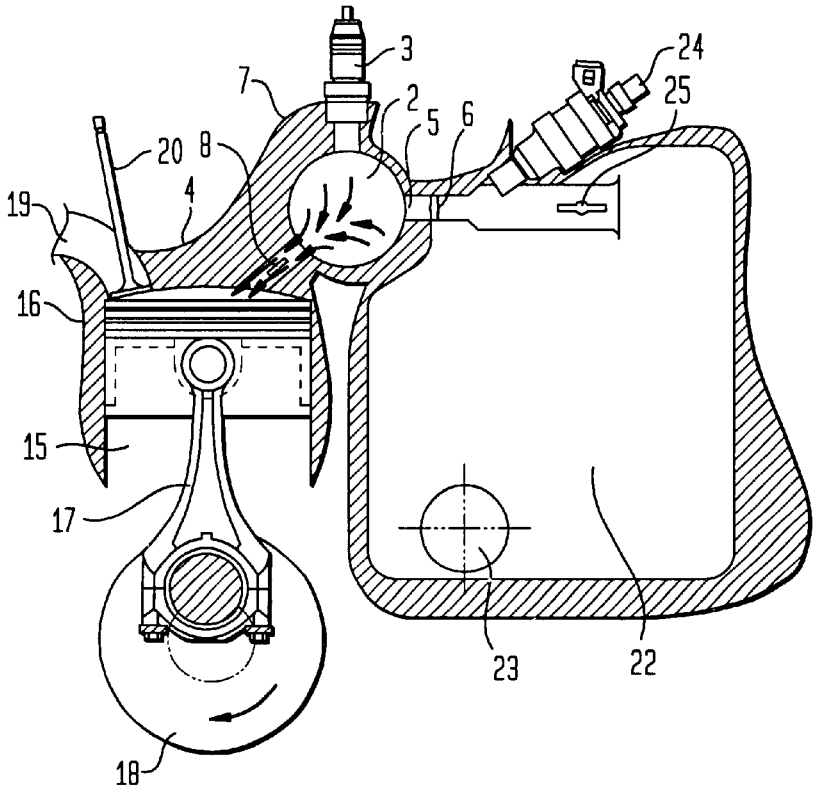
Figure 8:
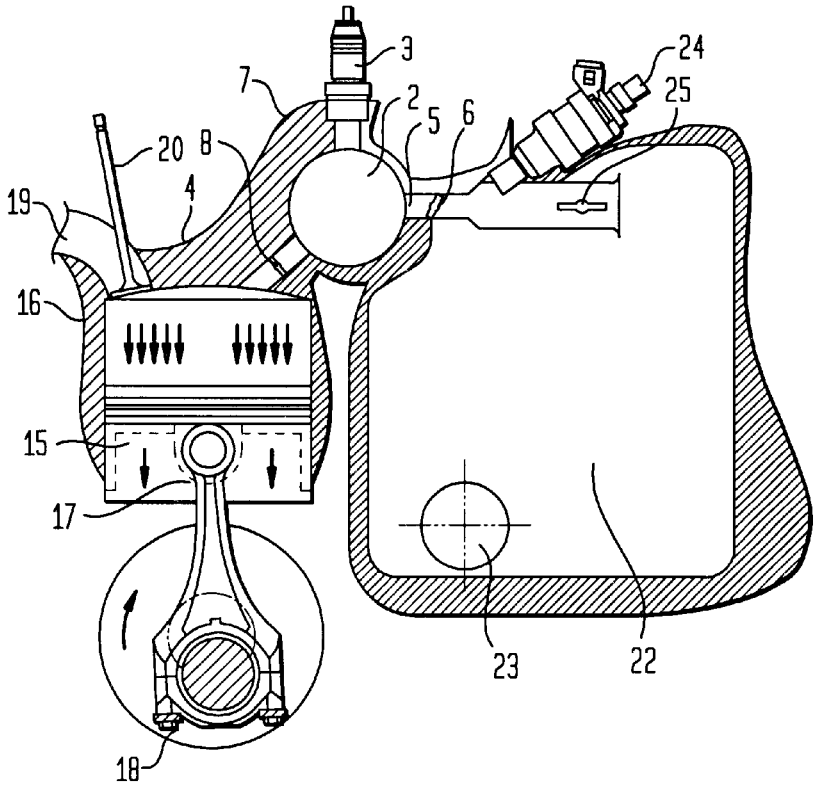
Figure 9:
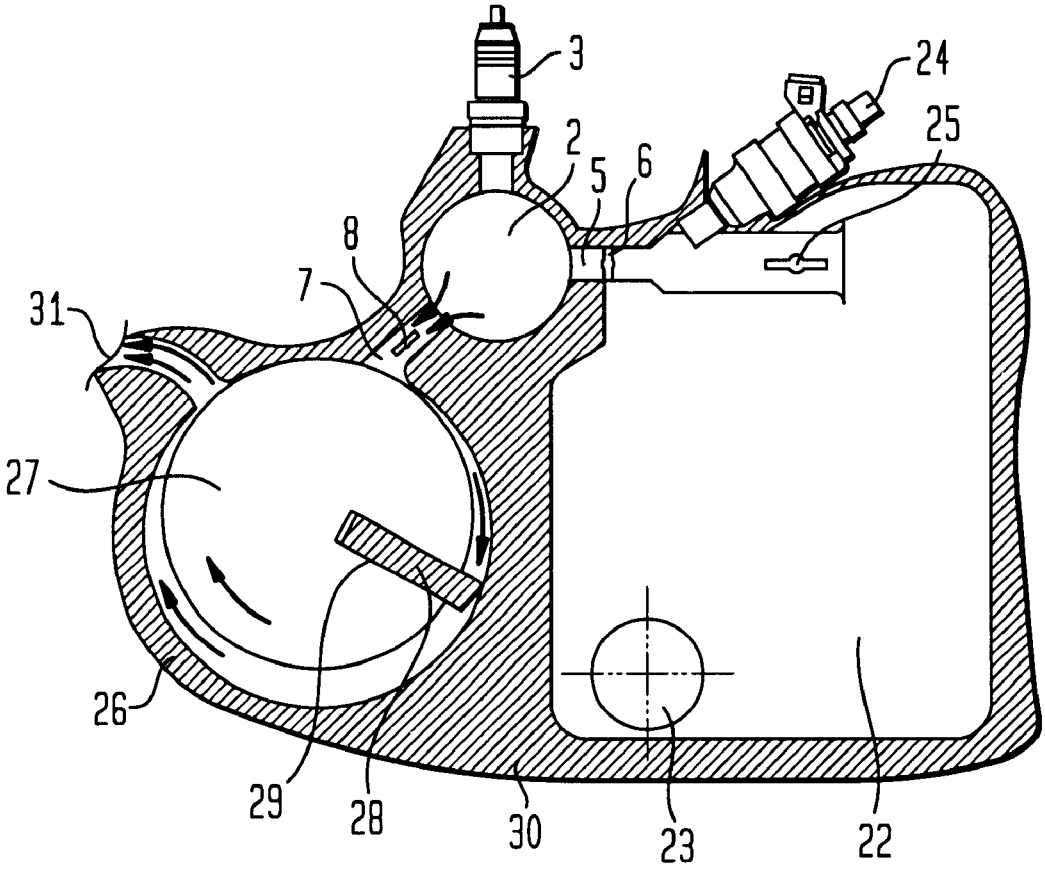

Other objects, advantages and features of the invention will emerge from reading the non-limiting description of a number of embodiments, which description is given with reference to the appended drawings in which:

FIG. 1 depicts diagrammatically, seen in cross section, one embodiment of the engine according to the invention, in which the compression and expansion chambers are each controlled by a rod-crank system and a piston sliding in a cylinder, FIG. 2 depicts this same engine after the air-fuel mixture has been introduced into the combustion chamber, FIG. 3 depicts this same engine at the moment of transfer of the gases from the combustion chamber to the expansion chamber, FIG. 4 depicts this same engine during exhaust and compression, FIG. 5 depicts another mode of operation, seen in cross section, in which a buffer volume in which compressed air accumulates is installed between the compressor and the combustion chamber, while the compressed air-fuel mixture is being let into the combustion chamber, FIG. 6 depicts this same engine during combustion, FIG. 7 depicts this same engine at the beginning of expansion, FIG. 8 depicts this same engine at the end of expansion, FIG. 9 depicts, in cross section, another embodiment, in which the expansion chamber is produced and expansion takes place in a rotary system of the type with radial vanes.

FIGS. 1 to 4 depict an embodiment of the engine according to the invention, in which the compression and expansion chambers are each controlled by a system comprising a rod and crank and a piston sliding in a cylinder, viewed in cross section, showing the compression chamber 1, the constant-volume independent combustion chamber 2 in which a spark plug 3 is installed, and the expansion chamber 4. The compression chamber 1 is connected to the combustion chamber 2 by a port 5 and the opening and closure of which are controlled by a sealed flap 6. The combustion chamber 2 is connected to the expansion chamber 4 by a transfer port 7, the opening and closure of which are controlled by a sealed flap 8.

The compression chamber is supplied with compressed air by a conventional reciprocating-compressor unit: a piston 9 sliding in a cylinder 10 controlled by a rod 11 and a crankshaft 12. The fresh air-fuel mixture is let in through an inlet port 13, the opening of which is controlled by a valve 14.

The expansion chamber 4 controls a conventional piston engine assembly: a piston 15 sliding in a cylinder 16 which, via a connecting rod 17, rotates a crankshaft 18, the burnt gases being discharged through an exhaust port 19, the opening of which is controlled by a valve 20.

The crankshaft 18 drives the compressor at the same speed via a connection 21 with an angular offset between the top dead center of the expansion piston and the top dead centre of the compressor piston, the latter being advanced by an angle chosen to suit the desired combustion period.

FIG. 1 depicts the engine when the compressor piston 9 is close to its top dead centre and the flap 6 has just opened to allow the constant-volume combustion chamber 2 to be supplied with fresh air-fuel mixture while the piston 15 of the expansion chamber 4 drives out through the exhaust 19 opened by the valve 20 the gases which were burnt and expanded in the previous cycle.

Continuing to rotate in the clockwise direction, FIG. 2, the compressor piston 9 has just passed through its top dead center and begins its down-stroke; the flap 6 has just been closed and closes off the port 5, the inlet valve 14 opens to allow replenishing with fresh air-fuel mixture from the compressor (inlet). As soon as the flap 6 closes, ignition is brought about by the spark plug 3 and the air-fuel mixture is burnt in the constant-volume independent chamber 2 while the expansion piston 15 continues its up-stroke and exhausts through the port 19.

As the crankshafts 12 and 18 continue to rotate (here depicted about 100° later), the expansion piston 15 reaches its top dead center, the exhaust valve 20 closes again and the sealed flap 8 is made to open; the gases under very high pressure contained in the independent combustion chamber 2 expand through the transfer port 7 in the expansion chamber 7 and drive the piston 15 back, thus producing the power stroke, while the compressor piston 9 is in the process of completing the inlet of fresh air-fuel mixture.

Expansion will continue over approximately 180° crank angle, FIG. 4; the sealed flap 8 is then closed again and the exhaust valve 20 opens, while the compressor piston 9 will compress the air-fuel mixture in the compression chamber 1 and the flap 6 will be opened to allow the new fresh air-fuel mixture into the constant-volume chamber 2 for the cycle to recommence (FIG. 1).

It will be readily observed that each rotation of the crankshaft (engine and compressor) corresponds to an expansion (or power stroke) and that the choice of offset between the top dead center of the compressor piston 9 and the top dead center of the expansion piston 15 determines the period for the combustion of the mixture in the constant-volume combustion chamber 2.

Incidentally, the expansion volume swept by the expansion piston 15 may be greater than the swept volume of the compressor 9. This difference can be determined as a function of the differences between the polytropic compression and expansion curves with a view to obtaining the lowest possible pressure at the end of expansion, as this is a sign of good efficiency and low acoustic emissions.

FIGS. 5, 6, 7 and 8 depict, seen diagrammatically in cross section, another embodiment of the engine according to the invention, in which inserted between the compressor and the constant-volume combustion chamber 2 is a buffer volume 22 of compressed air, supplied with compressed air through a port 23 by any appropriate means and kept at an essentially constant pressure, and which has the effect of avoiding certain surge effects and the pressure drops due to the dead transfer volume and the expansion during the filling of the combustion chamber 2. The port 5, the opening and closure of which are controlled by the flap 6, connects the buffer volume 22 of compressed air to the independent combustion chamber (2) and comprises a fuel injector 24 intended to perform the mixing of the air and the fuel somewhat before this mixture is introduced into the combustion chamber 2. A flap 25 also situated in this port allows the charge let into the combustion chamber to be adjusted (accelerator).

FIG. 5 depicts the engine when the flap 6 has just been opened to allow compressed air mixed with fuel atomized by the injector 24 through the port 5 into the constant-volume combustion chamber 2 while the expansion piston 15 has just begun its up-stroke to drive out to the atmosphere, via the port 19 (the exhaust valve 20 having been opened) the gases which were burnt and expanded in the previous cycle, and while the transfer port flap 8 has just closed again.

As soon as the mixture has been introduced into the independent combustion chamber 2, FIG. 6, the flap 6 is closed again and the independent combustion chamber 2 finds itself isolated; ignition is then brought about using the spark plug 3 and the air-fuel mixture is burnt in the constant-volume combustion chamber 2 while the expansion piston 15 continues its up-stroke and exhausts through the port 19.

The crankshaft 18 continues to rotate, FIG. 7, the expansion piston 15 reaches its top dead centre, the exhaust valve 20 closes again and the sealed flap 8 is made to open. The gases under very high pressure contained in the independent combustion chamber 2 expand through the port 7 into the expansion chamber 4 and drive back the piston 15, thus producing the power stroke.

Expansion will continue over about 180 degrees rotation of the crankshaft 18, FIG. 8, the sealed flap 8 is then closed again and the exhaust valve 20 opens; from this moment, the flap 6 is opened to let a new charge of fresh air-fuel mixture into the constant-volume chamber 2 so that the cycle can recommence (FIG. 5).

It will be observed that with the insertion of a buffer volume of compressed air, the principle of operation of the engine remains the same. However, the air compressor becomes completely independent, no longer has to be set at a particular angle with respect to the engine crankshaft 18 and its choice of principle is thereby made easier. Furthermore, the greater the volume of this buffer, the more the effects of surging and pressure drops in the transfer volume and on expansion during the filling of the combustion chamber will be lessened.

FIG. 9 depicts another mode of operation of the engine according to the invention, in which the expansion chamber is built and expansion takes place in a rotating rotary encapsulation device of the radial vane type consisting of a cylindrical outer casing or stator 26 in which there rotates about an off center axis, a drum or rotor 27 tangential to the stator and equipped with a radial vane 28 which slides freely in its housing 29 to be pressed against the interior wall of the stator 26, thus delimiting a variable volume between itself, the rotor and the stator, which volume increases from a low value that is practically zero near the generatrix of contact between rotor and stator. Pierced shortly after this generatrix and in the direction of rotation is the transfer port 7 (the opening and closure of which are controlled by the flap 8) providing the connection between the constant-volume combustion chamber 2 and the expansion chamber. An exhaust orifice 31 is pierced, this time before the generatrix of contact between the rotor and stator, still in the direction of rotation. As soon as the vane uncovers the port 7, the flap 8 is made to open and the gases under very high pressure contained in the combustion chamber 2 expand into the expansion chamber 30 and, pressing against the vane 28, cause the rotor to rotate, while the vane 28 drives out in front of it toward the exhaust 31 the gases which were burnt and expanded in the previous cycle. Closure of the flap 8 and opening of the flap 6 allowing the fresh charge in the independent chamber 2 to be renewed will occur at the end of the expansion phase when the vane 28 is close to the exhaust port 31.

The number of vanes and their positioning may vary, just as any other rotary system producing a rotating encapsulated system such as the path of a conchoid of a circle or a trochoid (rotary pistons of the Planche, Wankel, etc. type) can be used as an expansion chamber without that altering the principle of the invention which has just been described.

Of course, the invention is not in any way restricted to the embodiments described and depicted; it is susceptible to numerous alternative forms accessible to the person skilled in the art, depending on the envisaged application and without departing from the spirit of the invention.

What is claimed is:

1. A cyclic internal combustion engine comprising:

a compression chamber (1) having a first piston for performing a compression cycle defined by an inlet stroke and a compression stroke, the first piston connected to a first crankshaft;

a combustion chamber (2) for performing combustion;

an expansion chamber (4) having a second piston for performing an expansion cycle defined by an expansion stroke and an exhaust stroke, the second piston connected to a second crankshaft;

a connection for interconnecting the first crankshaft with the second crankshaft;

the chambers being separate from one another and connected by at least one duct equipped with a shutter;

means for generating an air-fuel mixture and delivering the mixture to the compression chamber (1) during the inlet stroke;

wherein an air-fuel mixture is compressed and ignited to produce a combusted air-fuel mixture to be expanded in the expansion chamber (4) when the expansion chamber (4) is generally at its smallest volume in order to produce work; and wherein the beginning of each inlet stroke of a work cycle is advanced in relation to the beginning of each expansion stroke of an immediately previous work cycle, so as to extend combustion of the work cycle during the exhaust stroke of the immediately previous work cycle to reduce the formation of polluting gases during the combustion of the work cycle.

2. The engine according to claim 1, wherein the combustion chamber has a generally spherical shape for obtaining, for a given volume, the smallest possible wall area with a view to avoiding heat loss through the said walls, and the shortest flame front distances, and the absence of "corners" where the air-fuel mixture does not burn and produces unburnt hydrocarbons.

3. The engine according to claim 1, wherein the combustion chamber (2) is coated with a thermal barrier made of a heat-insulating material so as not to lose heat through walls of the combustion chamber which can thus be kept at a very high temperature and thereby enable the flame not to be quenched on the walls, thus avoiding the production of unburnt hydrocarbons in the exhaust gases.

4. The engine according to claim 3, wherein the heat-insulating material comprises a ceramic.

5. The engine according to claim 1, wherein walls of the expansion chamber (4) are coated with a thermal barrier made of a heat-insulating material so as not to lose heat through the walls of the expansion chamber which can thus be kept at a high temperature and improve expansion efficiency.

6. The engine according to claim 5, wherein walls of the at least one connecting duct (8) between the expansion chamber and the combustion chamber (2) is coated with the heat-insulating material.

7. The engine according to claim 6, wherein the heat-insulating material comprises a ceramic.

8. The engine according to claim 1, further comprising a buffer volume of compressed air fitted between the compression chamber (1) and the combustion chamber (2), the buffer volume (22) of compressed air making it possible to avoid surge effects and pressure drops due to the dead transfer volume and to the expansion during the filling of the combustion chamber.

9. The engine according to claim 8, wherein the at least one duct includes a connecting port (5), the connecting port (5) being located between the buffer volume (22) and the combustion chamber (2).

10. The engine according to claim 1, wherein walls of the at least one connecting duct (8) between the expansion chamber and the combustion chamber (2) is coated with the heat-insulating material.

11. The engine according to claim 10, wherein the heat-insulating material comprises a ceramic.

12. The engine according to claim 1, wherein the beginning of each inlet stroke of the work cycle is advanced up to 180° in relation to the beginning of each expansion stroke of the immediately previous work cycle.

* * * * *